US010149531B2

(12) United States Patent
Arevalo

(10) Patent No.: US 10,149,531 B2
(45) Date of Patent: Dec. 11, 2018

(54) LANDSCAPING TOOL HOLDER AND CARRIER

(71) Applicant: Jose A. Arevalo, Livermore, CA (US)

(72) Inventor: Jose A. Arevalo, Livermore, CA (US)

( * ) Notice: Subject to any disclaimer, the term of this patent is extended or adjusted under 35 U.S.C. 154(b) by 0 days.

(21) Appl. No.: 15/827,536

(22) Filed: Nov. 30, 2017

(65) Prior Publication Data

US 2018/0146772 A1 May 31, 2018

Related U.S. Application Data

(60) Provisional application No. 62/427,872, filed on Nov. 30, 2016.

(51) Int. Cl.

| | |
|---|---|
| ***A45F 5/14*** | (2006.01) |
| ***B25H 3/04*** | (2006.01) |
| *A45F 5/10* | (2006.01) |

(52) U.S. Cl.

CPC ..... *A45F 5/14* (2013.01); *B25H 3/04* (2013.01); *A45F 2005/1013* (2013.01); *A45F 2200/0566* (2013.01); *A45F 2200/0575* (2013.01)

(58) Field of Classification Search

CPC ..... A45F 2200/0566; A45F 2200/0575
USPC ..... 224/242, 251
See application file for complete search history.

(56) References Cited

U.S. PATENT DOCUMENTS 85,129 A * 12/1868 Porter et al. ..... A45F 5/10 294/154
310,641 A * 1/1885 Beatty ..... A45F 5/10 294/154
448,657 A * 3/1891 Loveless ..... A45F 5/10 294/150
473,566 A * 4/1892 Caplis ..... A45F 5/10 294/155
2,376,955 A * 5/1945 Ball ..... A47B 81/005 211/60.1
3,116,730 A * 1/1964 Tingley ..... F41B 5/066 124/24.1
3,960,302 A * 6/1976 Mazzoni, Jr. ..... A63C 11/025 224/257
4,002,277 A * 1/1977 Westerholm ..... A45F 5/00 280/814
4,114,838 A * 9/1978 Knauf ..... A45F 5/00 224/917
4,724,989 A * 2/1988 Silberberg ..... A45F 3/14 224/250
5,005,509 A * 4/1991 Williams ..... B63B 17/00 114/343
D320,696 S * 10/1991 Butler ..... D3/259
5,468,036 A * 11/1995 Brown ..... A63C 11/021 224/917
6,966,589 B1 * 11/2005 Grbic ..... A45C 13/30 294/150
7,229,112 B2 * 6/2007 Grbic ..... A45C 13/30 294/142

(Continued)

*Primary Examiner* — Brian D Nash

(74) *Attorney, Agent, or Firm* — Greg N. Geiser; Gutwein Law

(57) ABSTRACT

A combination tool holding and transport device. The device having a pair of ends with each end of the pair of ends having an attachment side and a hanging side. The attachment side including a securing means adapted to secure the handle portion of the tool. Each end of the pair of ends coupled together with a connecting member. The connecting member having a handle.

10 Claims, 8 Drawing Sheets

(56) References Cited

U.S. PATENT DOCUMENTS

| | | | | |
|---|---|---|---|---|
| 8,616,600 | B2 * | 12/2013 | Owen | A63C 11/025 224/917 |
| 9,193,428 | B2 * | 11/2015 | Reed | B63H 16/04 |
| 9,809,288 | B1 * | 11/2017 | Newhard | B63H 16/04 |
| 2003/0173382 | A1 * | 9/2003 | Robinson | A45F 3/14 224/259 |
| 2010/0282627 | A1 * | 11/2010 | Paschke | A45C 5/03 206/315.11 |
| 2011/0215013 | A1 * | 9/2011 | Young | A63B 55/10 206/315.2 |

* cited by examiner

LANDSCAPING TOOL HOLDER AND CARRIER

CROSS REFERENCE TO RELATED APPLICATIONS

This application claims priority to U.S. Provisional Patent Application No. 62/427,872 filed 30 Nov. 2016 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The invention relates generally to a landscaping tool tote.

BACKGROUND OF THE INVENTION

Often spaces and places get cluttered with tools. This is especially true when attempting to store long handled landscaping tools such as, shovels and rakes. Typically these tools are placed against a wall within a garage or storage shed or hung by hooks within these structures. Still further, there exist organization and rack systems with the art that are affixed to the wall to generally organizing and storing these types of tools.

During a typical use of these tool types, a user will remove each tool individually from the hanger and transport a bundle of tools or individual tools one by one to a jobsite. This process is both time consuming in beginning the task and during clean-up when the task is completed.

In another common solution, a user will utilize a wheeled cart to transport tools. Although useful, the cart still requires the loading and unloading of individual tools and may be difficult to navigate across various terrains and jobsites as the wheels may get caught on roots, bumps and other obstructions on the surface the cart is wheeled upon.

Therefore, there is a need within the art for an improved tool storage device. Preferably this device is specifically adapted for use with outdoor landscaping tools and provides a solution for both hanging storage and transport.

SUMMARY OF THE INVENTION

The device of the present disclosure is most generally related to a landscaping tool holder and transportation device. The device is comprised of a pair of irregular shaped end portions spaced apart from each other and attached to each other by a plurality of support members. The irregular shaped ends are preferably hexagonal in shape and include at least five (5) storage clips on at least five (5) sides of the device and adapted to receive the handle portion of various tools (i.e. shovels, brooms, etc.). A first end of the device first includes a hanger portion on a side not including a storage clip, wherein the hanger allows the device to be hung up on a wall.

The device is designed for the combination of tool storage and tool transport, wherein the device is adapted for removable mounting on a surface and easy transport to a job location. Accordingly, the device is comprised of a first end and a second end in an opposed spatial configuration and in communication through a plurality of connecting members attached to the first end and the second end. Preferably the device includes at least a pair of connecting, with three (3) connecting members being ideal to ensure structural integrity of the device during use.

The first end and the second end are configured in an irregular hexagonal shape with five (5) sides of the ends having a similar length and the sixth ($6^{th}$) side having a length greater than the individual length of the five sides, wherein this sixth side provides a generally flattened surface for placement along a wall surface during mounting of the device. The five sides of the ends of the device include a securing means. The securing means providing a grasping force to the handle of a tool and wherein the securing means is preferably constructed of a rubber-like material and comprised of a pair of flexible/movable arms.

The first end includes a hanger. The hanger is positioned perpendicular to the tool-retaining portion of the first end and coplanar with the sixth side parallel to a length of the device, wherein the hanger is adapted for positioning flat against the wall surface for hanging and adapted to be easily placed onto a fastener for hanging.

The device further includes carrying straps forming a handle. The carrying straps affixed to a connecting member and allowing a user to easily carry the device. Preferably the straps are comprised of a durable fabric material, such as nylon webbing, for strength and flexibility.

In use, the device is adapted for placement on a wall and carrying to a job location. Accordingly, the handle portion of a tool is received within the securing means of the device. All of the securing means of the device can be affixed with a tool or only a few. Additionally, the device can remain on the wall and single tool utilized or the device can be removed with the tools affixed and engaged within the grasping means and easily carried to the work location. Accordingly, the device operates as a combination tool holder and tool transport apparatus.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
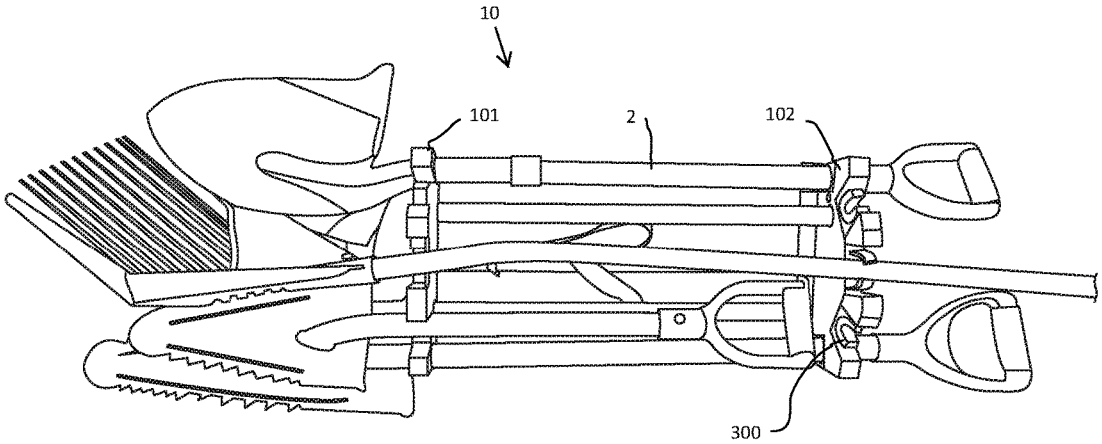
FIG. 1 is a view of the device with tools installed, according to the present disclosure.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention is directed to a combination tool holder and tote device adapted for use with landscaping and other similar long handled tools. Accordingly the device is adapted for removable hanging on a wall surface and transport to a jobsite.

Figure 2:
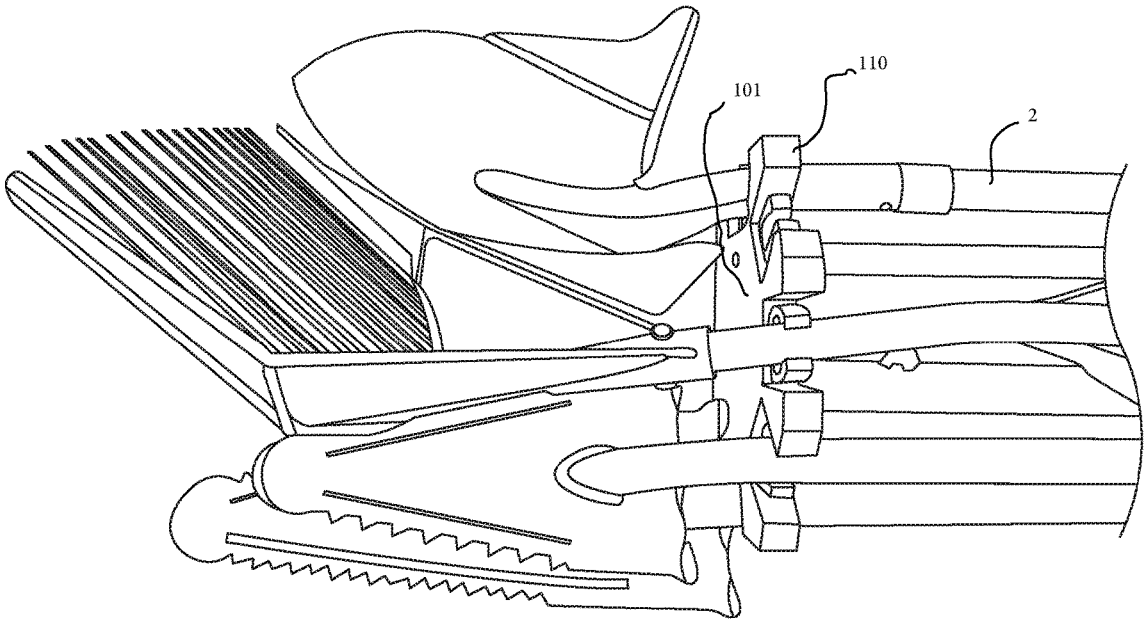
FIG. 2 is an exploded view of an end of the device with tools installed, according to the present disclosure.
Figure 3:
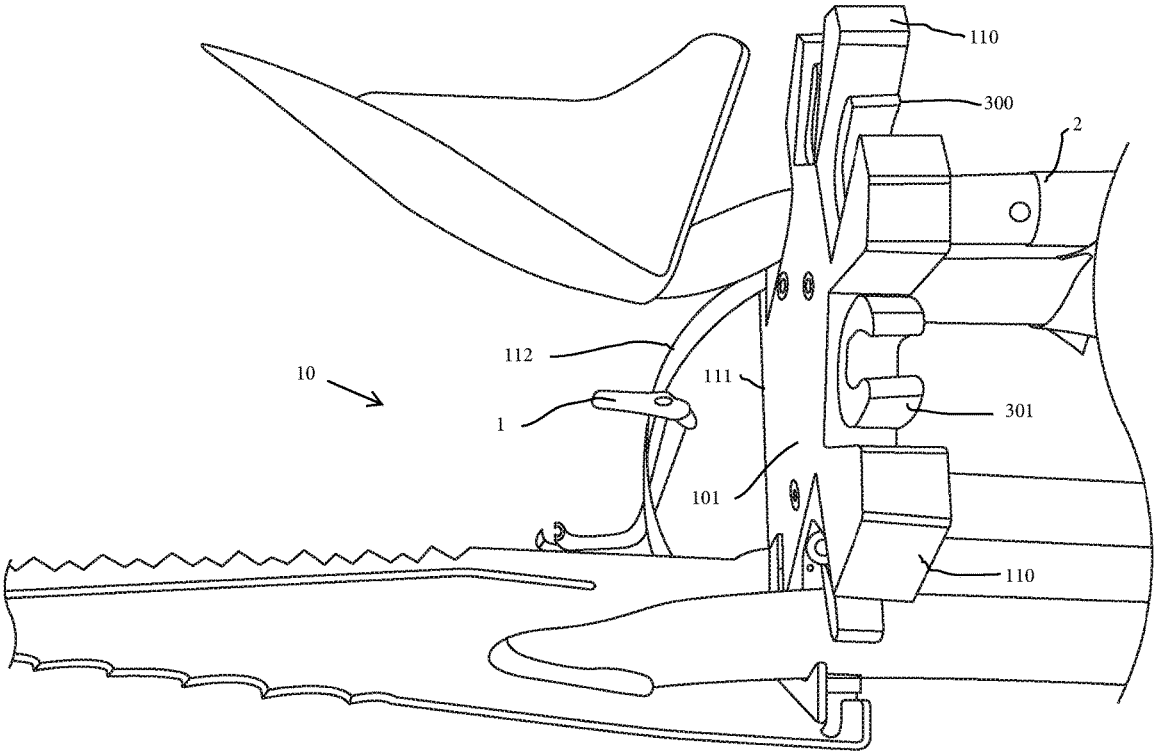
FIG. 3 is an exploded view of the device with hanger shown, according to the present disclosure.
Figure 4:
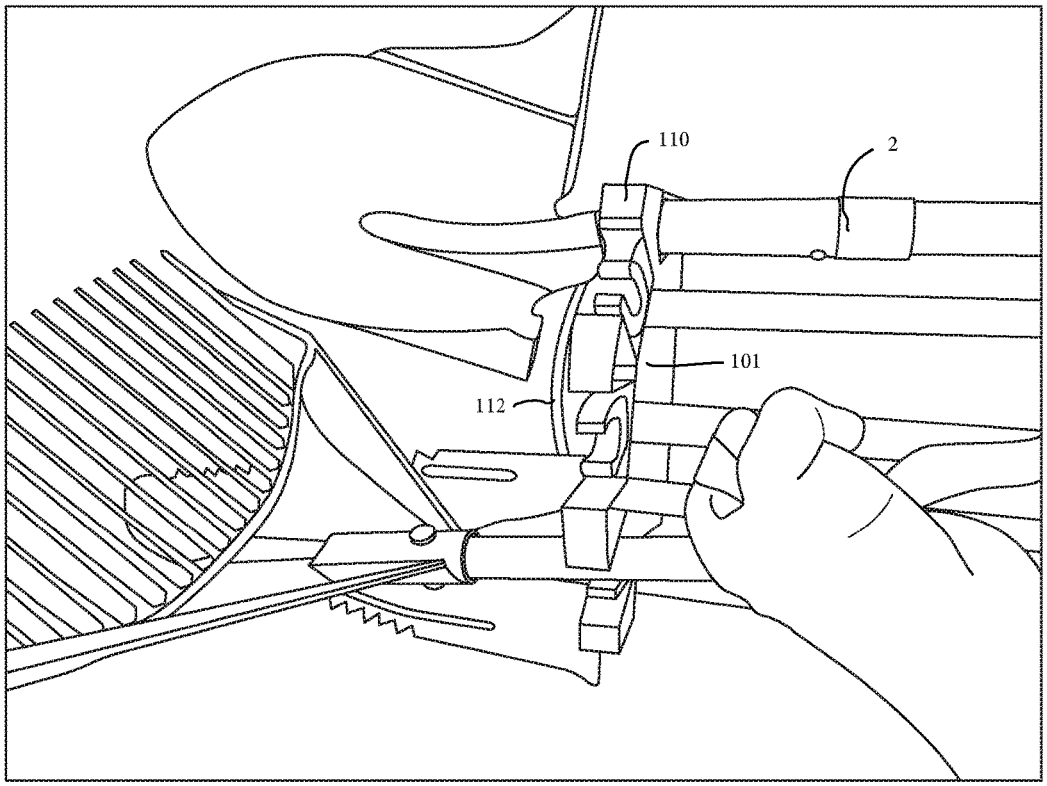
FIG. 4 is an exploded view of a user carrying the device, according to the present disclosure.
Figure 5:
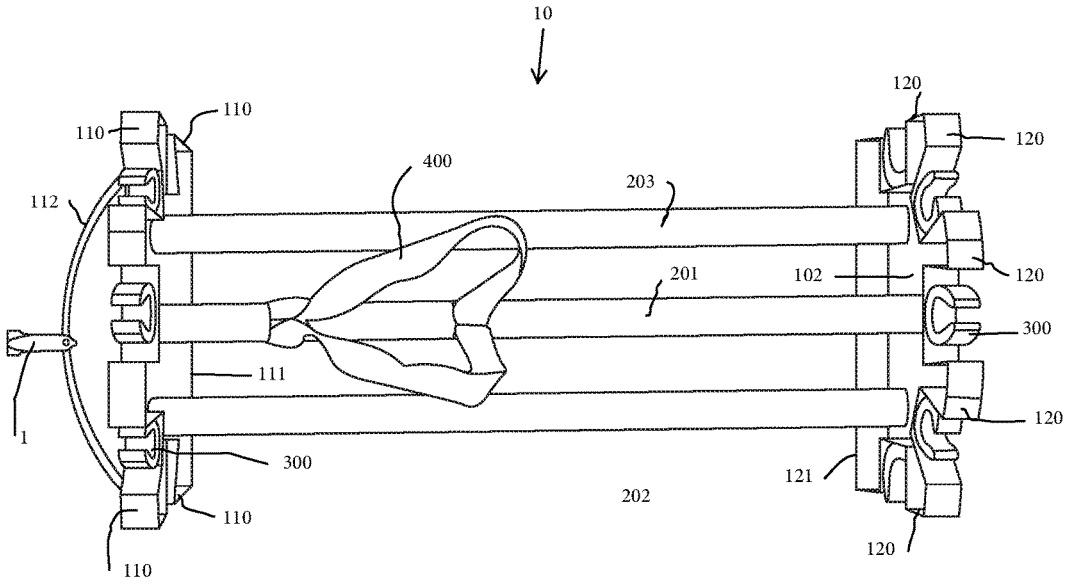
FIG. 5 is front view of the device without tools and hung on a surface, according to the present disclosure.
Figure 6:
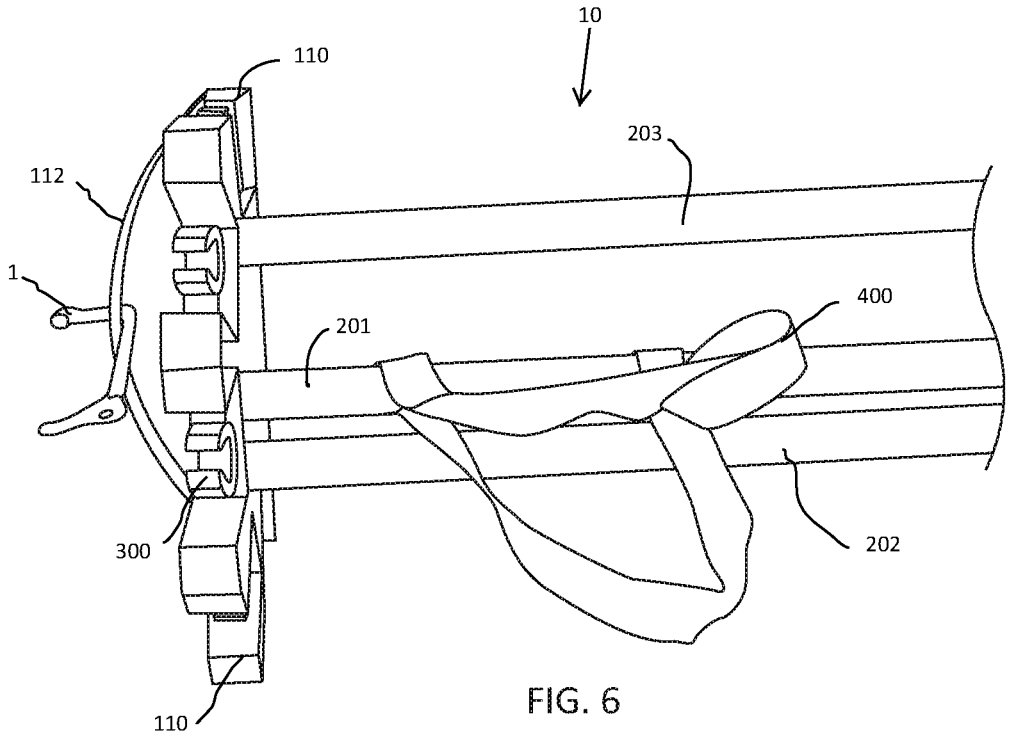
FIG. 6 is front exploded view of the device without tools and hung on a surface, according to the present disclosure.
Figure 7:
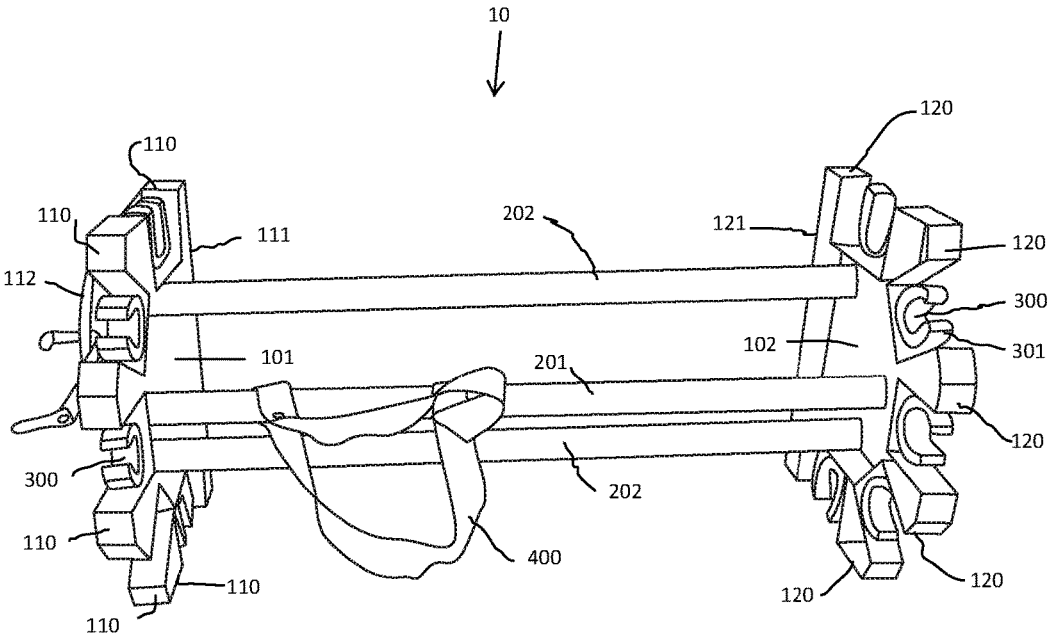
FIG. 7 is front isometric view of the device without tools and hung on a surface, according to the present disclosure.
Figure 8:
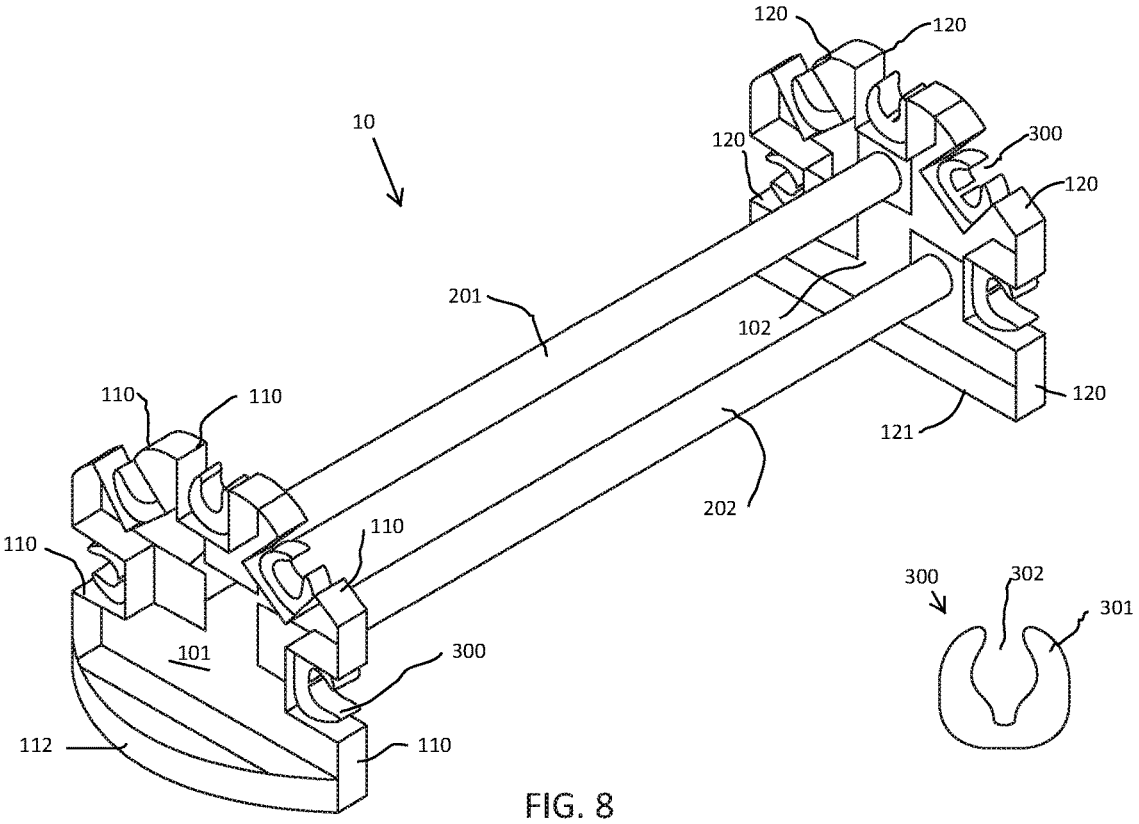
FIG. 8 is an isometric view of the device without tools and including close-up view of a securing means, according to the present disclosure.

Referring to the figures, FIGS. 1-8 show the landscaping tool holder and hanging device of the present disclosure and generally referred to as device 10. The device 10 is designed for the combination of hanging tool storage and tool transport, wherein the device 10 is adapted for removable mounting on a surface and easy transport to a job location.

Accordingly, the device 10 is comprised of a first end 101 and a second end 102 in an opposed spatial configuration and in communication through a plurality of connecting members 201, 202, 203 coupled to the first end 101 and the second end 102. Preferably, the connecting members 201-203 are adapted to provide structure and rigidity to the device 10 during use.

The first end 101 and the second end 102 are configured in an irregular hexagonal shape with five (5) sides of the ends 101, 102 having a similar length and referred to as attachment sides 110, 120 and a sixth ($6^{th}$) side referred to as the hanging side 111, 121 having a length greater than the individual length of the attachment the sides 110, 120, wherein the hanging side 111, 121 provides a generally flat surface for placement along a wall surface during mounting of the device 10.

The attachment sides 110, 120 of the ends 101, 102 of the device 10 include a securing means 300. The securing means 300 providing a grasping force to the handle of a tool and wherein the securing means 300 is preferably constructed of a rubber-like material and comprised of a pair of flexible/movable arms 301 in a U-shape. The securing means 300 arms 301 defining a cavity 302. The cavity 302 having a size to correspond generally to the diameter of the handle end of a standard landscape or long handled tool. Most commonly this diameter is one and one half inches (1.5").

The first end 101 includes a hanger 112. The hanger 112 is positioned perpendicular to the tool-retaining portion of the attachment sides 110 of the first end 101 and coplanar with the hanging side 111 parallel to a length of the device, wherein the hanger 112 is positioned flat against the wall surface for hanging and adapted to be easily placed onto a fastener 1 for hanging.

The device 10 further includes a handle 400, preferably in the form of flexible carrying straps. The handle 400 affixed to a connecting member 201, 202, 203 and allowing a user to easily carry the device 10. Preferably the handle 400 is comprised of a durable fabric material, such as nylon webbing, for strength and flexibility.

In use, the device 10 is adapted for placement on a wall and carrying to a job location. Accordingly, the handle of a tool 2 is received within the securing means 300 cavity 302 of the device 10. All of the securing means 300 of the device 10 can be affixed with a tool 2 or only a few. Additionally, the device 10 can remain on the wall and a single tool 2 utilized or the device 10 can be removed with the tools 2 affixed and easily carried to the work location. Accordingly, the device 10 operates as a combination tool holder and tool transport apparatus.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A tool holding device for storage and transport of long handled tools, the device comprising:

a pair of ends, each end of the pair of ends having an identical shape, each end of the pair of ends including:

at least five attachment sides, the at least five attachment sides having a securing means, the securing means providing a grasping force to a handle of a tool; and a hanging side in communication with the attachment sides;

at least two connecting members, the at least one connecting members coupled to each end of the pair of ends; and a handle, the handle coupled to the at least one connecting member, wherein the handle allows a user to carry the device.

2. A tool holding device as in claim 1, wherein a first end of the pair of ends includes a hanger on the hanging side, the hanger forming an attachment surface.

3. A tool holding device as in claim 2, wherein the device securing means includes a pair of flexible arms defining a cavity, the cavity sized to correspond a diameter of the tool handle.

4. A device as in claim 3, wherein the cavity has a diameter of 1.5 inches.

5. A tool holding device for storage and transport of landscape tools having a handle, the device comprising:

a pair of ends, each end of the pair of ends having an identical hexagonal shape, each end of the pair of ends including:

five attachment sides, the five attachment sides having a securing means, the securing means providing a grasping force to the handle of the tool; and a hanging side in communication with two of the attachment sides;

at least two connecting members, the at least two connecting members coupled to each end of the pair of ends; and a handle, the handle coupled to the at least one connecting member, wherein the handle allows a user to carry the device.

6. A tool holding device as in claim 5, wherein a first end of the pair of ends includes a hanger on the hanging side, the hanger forming an attachment surface.

7. A tool holding device as in claim 6, wherein the device securing means includes a pair of flexible arms defining a cavity, the cavity sized to correspond a diameter of the tool handle.

8. A device as in claim 7, wherein the cavity has a diameter of 1.5 inches.

9. A tool holding device as in claim 5, wherein the handle is comprised of a flexible material.

10. A tool holding device as in claim 5, wherein the hanging side has a first length and the five attachment sides have a second length, the first length of the hanging side being greater than the second length of the five attachment sides.

* * * * *